US007147512B2

(12) United States Patent
Wu

(10) Patent No.: US 7,147,512 B2
(45) Date of Patent: Dec. 12, 2006

(54) CONNECTOR ASSEMBLY

(75) Inventor: Jerry Wu, Irvine, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 42 days.

(21) Appl. No.: 11/110,334

(22) Filed: Apr. 19, 2005

(65) Prior Publication Data

US 2006/0234556 A1 Oct. 19, 2006

(51) Int. Cl.
*H01R 13/648* (2006.01)

(52) U.S. Cl. ..... 439/608

(58) Field of Classification Search ..... 439/607–610, 439/101, 701, 108, 79, 76.1, 579
See application file for complete search history.

(56) References Cited

U.S. PATENT DOCUMENTS 6,102,747 A * 8/2000 Paagman ..... 439/701
6,217,364 B1 * 4/2001 Miskin et al. ..... 439/358
6,220,895 B1 * 4/2001 Lin ..... 439/607
2004/0115988 A1 6/2004 Wu

* cited by examiner

*Primary Examiner*—J. F. Duverne
(74) *Attorney, Agent, or Firm*—Wei Te Chung

(57) ABSTRACT

A connector assembly (100) includes a cable (1), an insulative organizer (2), a metal presser (3) and a printed circuit board (PCB, 4). The cable has at least two pairs of wires (10). The organizer has a pair of organizer-haves (20, 21) stacked together and arranged in mirror image. Each organizer-half defines at least a pair of passageways (202) receiving corresponding wires of the cable, thereby arranged the wires into an upper row and a lower row. The presser has a pair of presser-halves (30, 31) attached to the organizer-halves of the organizer and pushing each of the wire into corresponding passageways. The printed circuit board has at least a circuit trace (40, 41) thereon to be electrically connected with the wire of the cable.

9 Claims, 4 Drawing Sheets

CONNECTOR ASSEMBLY

BACKGROUND OF THE INVENTION

1. Field of the Invention

The present invention relates to a connector assembly, and more particularly to a connector assembly used in high-speed application.

2. Description of the Prior Art

Certain demanding applications require multi-wire cable assemblies. To avoid undesirably bulky cables when substantial numbers of conductors are required, very fine conductors are used. To limit Electro Magnetic Interference, coaxial wires having grounding means are normally used for the conductors. A dielectric sheath surrounds a central conductor, and electrically separates it from the conductive grounding means. A bundle of such wires is surrounded by a conductive braided shield, and an outer protective sheath.

U.S. Patent Application Publication No. 2004/0115988 A1 discloses a high-speed connector assembly. The connector assembly includes a cable having a plurality of wires, a spacer having upper and lower halves to align front ends of the wires, a plurality of shielding plates assembled to the upper and lower halves of the spacer, and a printed circuit board (PCB) having circuit traces on opposite surfaces thereof. Each wire is located between two neighboring shielding plates, and includes a pair of signal conductors and a grounding conductor which isolates from the signal conductors and forms at right angle to the axis of the signal conductors. The signal conductors of the cable are soldered to corresponding circuit traces of the PCB for signal transmission. The grounding conductor of each wire is electrically connected to the PCB to form the grounding path in such manner that the grounding conductor of each wire is soldered to a corresponding shielding plate which has an engaging arm soldered to a corresponding circuit trace of the PCB.

However, in order to increase production efficiency and facilitate assembly of the connector assembly mentioned above, it is tried by manufacturers to design simpler structure and manufacture the connector assembly at lower cost while achieving more precisely electric connection.

Therefore, an improved connector assembly used in high-speed application is needed.

BRIEF SUMMARY OF THE INVENTION

A major object of the present invention is to provide an improved connector assembly having easier assembly process.

In order to achieve the object set forth above, A connector assembly includes a cable, an insulative organizer, a metal presser and a printed circuit board (PCB). The cable has at least two pair of wires. The organizer has a pair of organizer-haves stacked together and arranged in mirror image. Each organizer-half defining at least a pair of passageways receiving corresponding wires of the cable, thereby arranging the wires into an upper row and a lower row. The presser has a pair of presser-halves attached to the organizer-halves of the organizer and pushing each or the wire into corresponding passageways. The printed circuit board has at least circuit traces on top and bottom surfaces thereof to be the wire of the cable.

Other objects, advantages and novel features of the invention will become more apparent from the following detailed description when taken in conjunction with the accompanying drawings.

DETAILED DESCRIPTION OF THE PREFERRED EMBODIMENT

Figure 1:
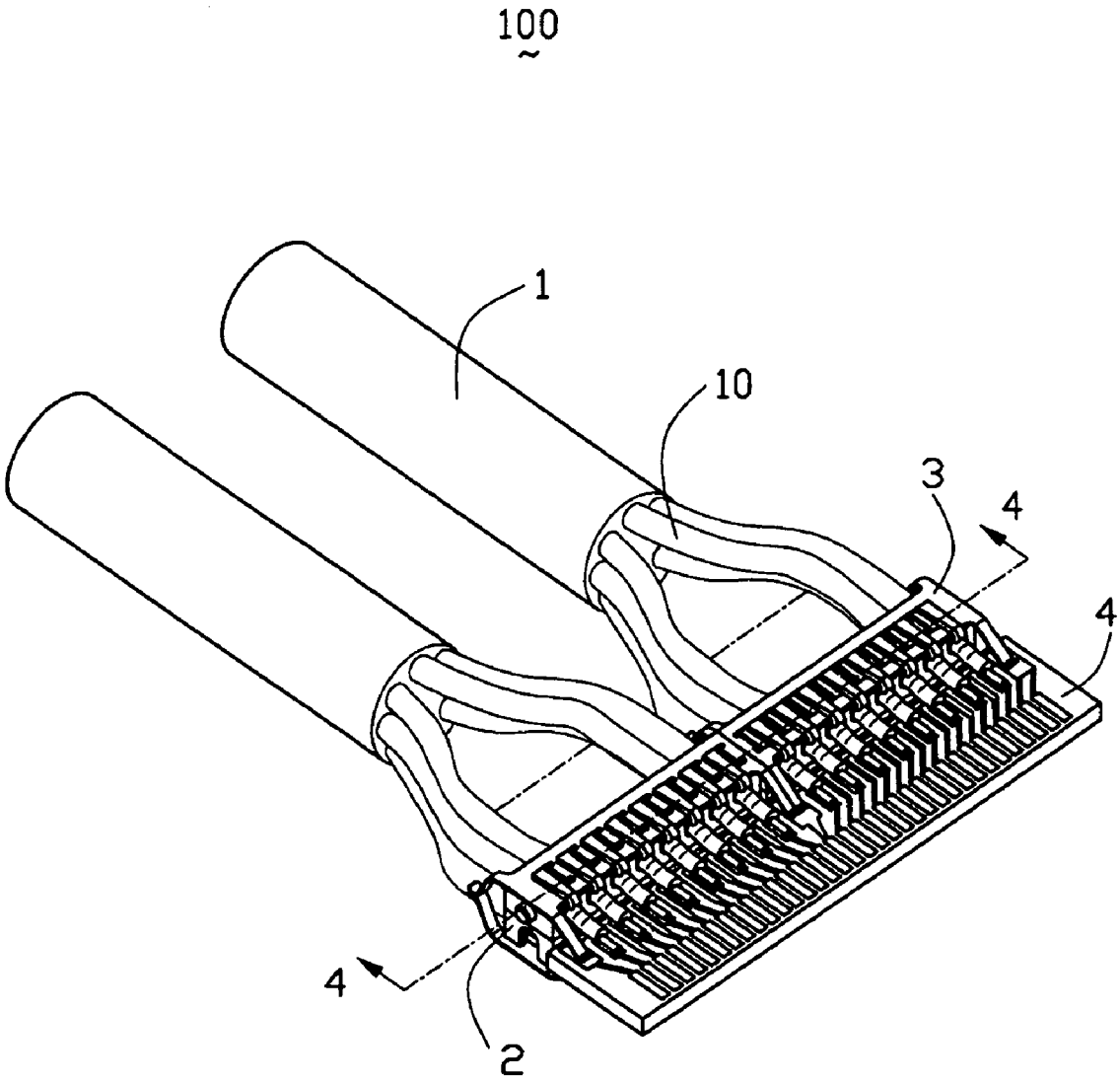
FIG. 1 is an assembled, perspective view of a connector assembly according to the present invention.

A connector assembly of the present invention is an E1 (the European format for digital transmission) connector assembly. The E1 connector assembly comprises a connector assembly and a cover assembly enclosing the connector assembly. The configuration of the cover assembly is known to skill in the art, so description of the cover assembly will be omitted hereinafter. With reference now to the drawings and in particular with reference to FIGS. 1–3, the connector assembly 100 of the present invention is shown and comprises a pair of multi-wire cables 1 arranged side-by-side, a pair of insulative organizers 2 used to align the multi-wire cables 1, a pair of metal pressers 3 attached to corresponding organizers 2 and a printed circuit board 4 (PCB) covered with a plurality of circuit traces 40 on top and bottom surfaces thereof for being terminated with the multi-wire cables 1.

Figure 3:
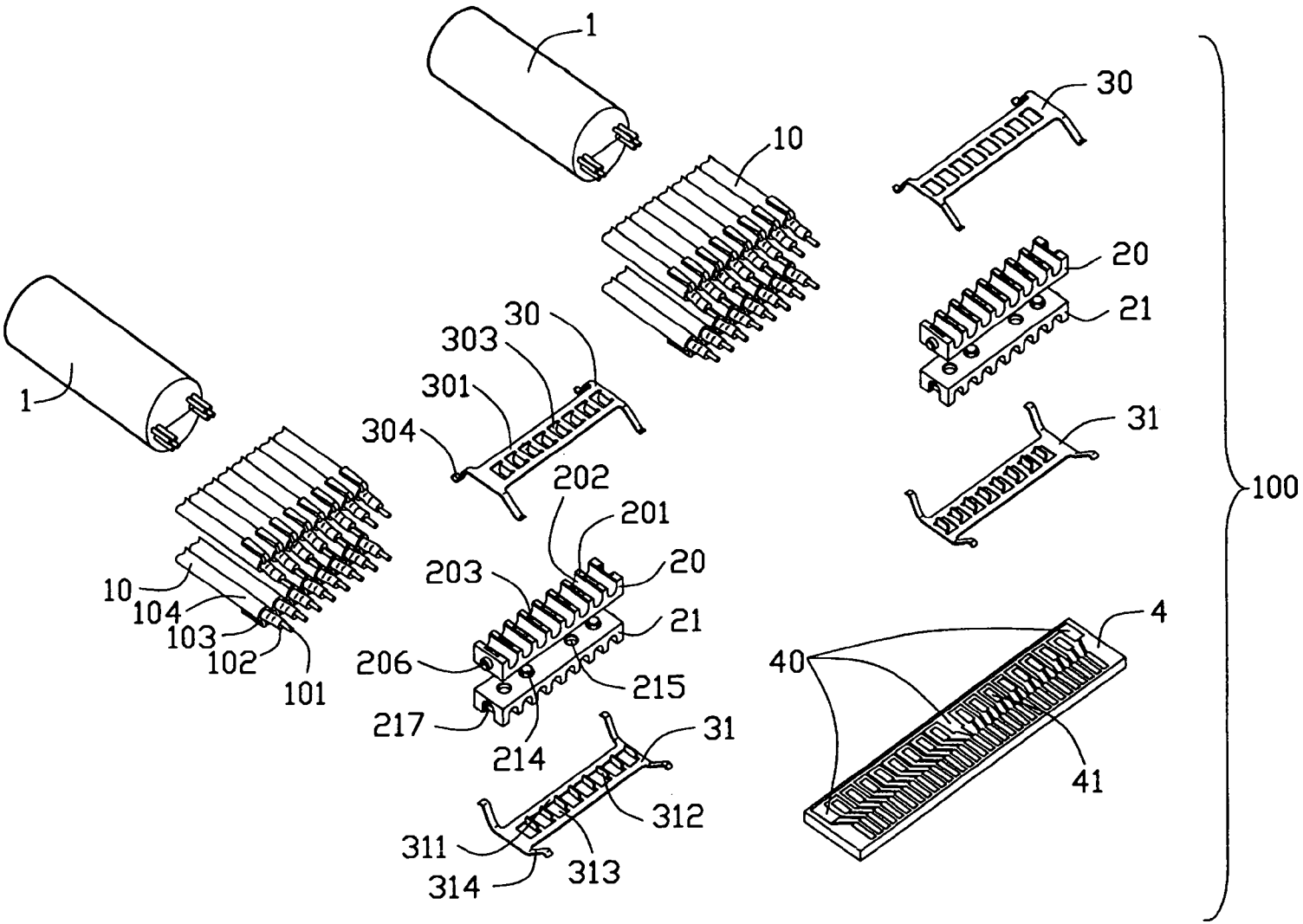
FIG. 3 is an exploded, perspective view of the connector assembly of FIG. 1.

The multi-wire cable 1 as best shown in FIG. 3 includes a plurality of individual wires 10 arranged in two rows, one disposed another. Each of the wires 10 includes a signal conductor 101 that is covered with an inner-jacket 102 and surrounded by an outer-jacket 104. The signal conductor 101 is typically formed of standard copper conductor, and the inner-jacket 102 and the outer-jacket 104 are made of insulating material. A grounding conductor 103 is located between the inner-jacket 102 and the outer-jacket 104 so as to isolate from the signal conductor 101. The grounding conductor 103 is applied along the length of the signal conductor 101 and a front end of the grounding conductor 103 is reversed beyond the out-jacket 104. A portion of the inner-jacket 102 is removed in to expose the signal conductor 101 in preparation of termination, while a portion of the outer-jacket 104 is further removed to expose the grounding conductor 103 to make contact with the presser 3.

Figure 4:
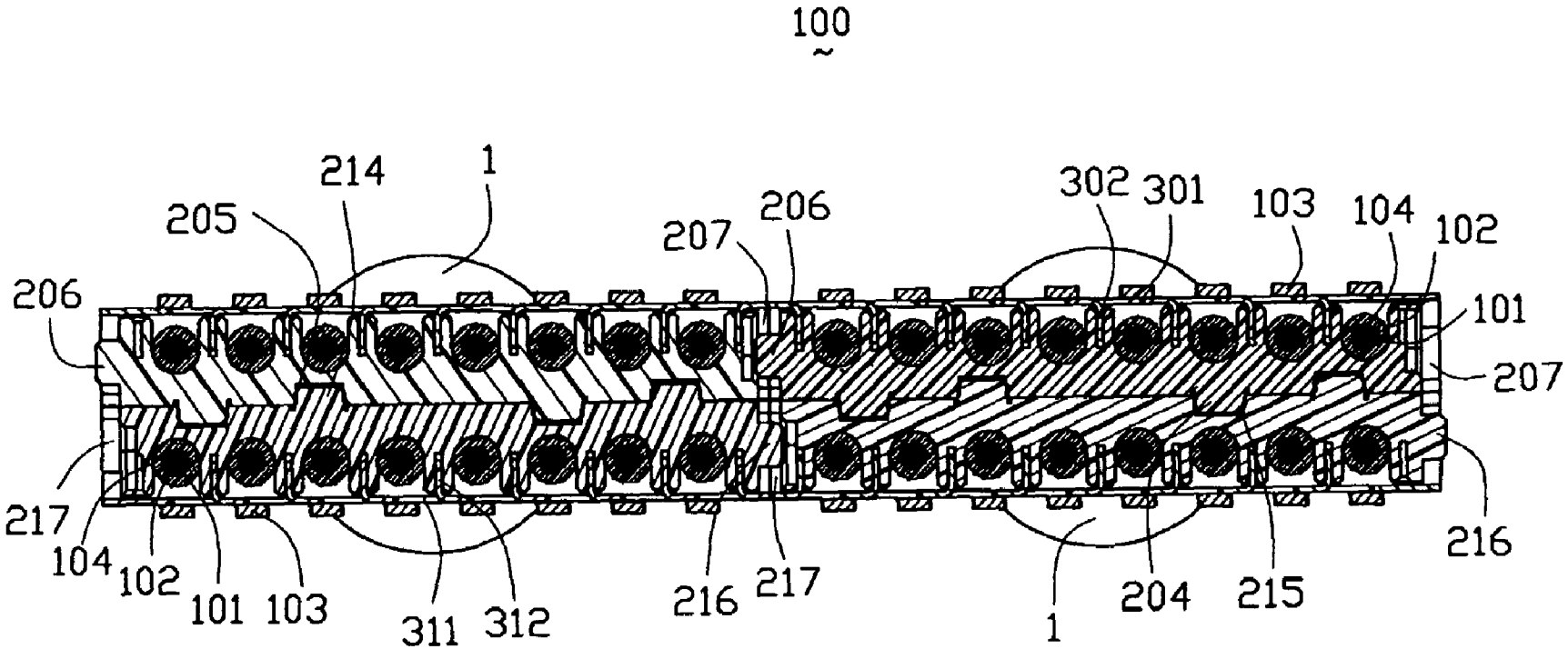
FIG. 4 is a cross-sectional view taken along line 4—4 of FIG. 1.

In conjunction with FIG. 4, the insulative organizer 2 is a two-piece member formed of a first organizer-half 20 and a second organizer-half 21. The first and second organizer-halves 20, 21 are identical but oriented in opposite directions to be mirror images of each other as best shown in FIG. 3. The first and second organizer-halves 20, 21 respectively have a pair of bulge portions 204, 214 and a pair of recessed portions 205, 215, and wherein the bulge portions 204(214) of one organizer-half 20(21) press-fit into the recessed portions 205(215) of the other organizer-half 21(20) to hold the organizer-halves 20, 21 back-to-back together. In the preferred embodiment, the pair of bulge portions 204(214) are in the form of posts, the recessed portions 205(215) are in the form of holes, and the bulge portions 204(214) and the recessed portions 205(215) alternatively locate at a first wall of each organizer-half 21(20). A second wall opposite to the first wall of each organizer-half 21(20) is slotted to form a plurality of partitions 201 and a plurality of passageways 202 between two neighboring partitions 201. Each partition 201 (not shown) defines a slot 203 at middle region and extending along an extension direction of the passageways 202. Furthermore, each organizer-half 20(21) forms an embossment 206(216) at one lateral side thereof and a depression 207(217) at the opposite lateral side thereof.

The metal presser 3 is a two-piece one formed of a first presser-half 30 and a second presser-half 31. The first and second presser-halves 30, 31 are identical but oriented in opposite directions to be mirror images of each other located as best shown in FIG. 3. Each presser-half 30(31) is configured to have an elongated body 301(311) with four slender legs 304(314) which are symmetrically arranged approximate to lateral ends of the body 301(311). The body 301(311) is punched to bring a plurality of vertical slices 302(312) and correspondingly leave a plurality of cutouts 303(313) arranged in a row. The size and shape of the slices 302 of the pressers 3 correspond to those of the slots 203 of the organizers 2.

Figure 2:
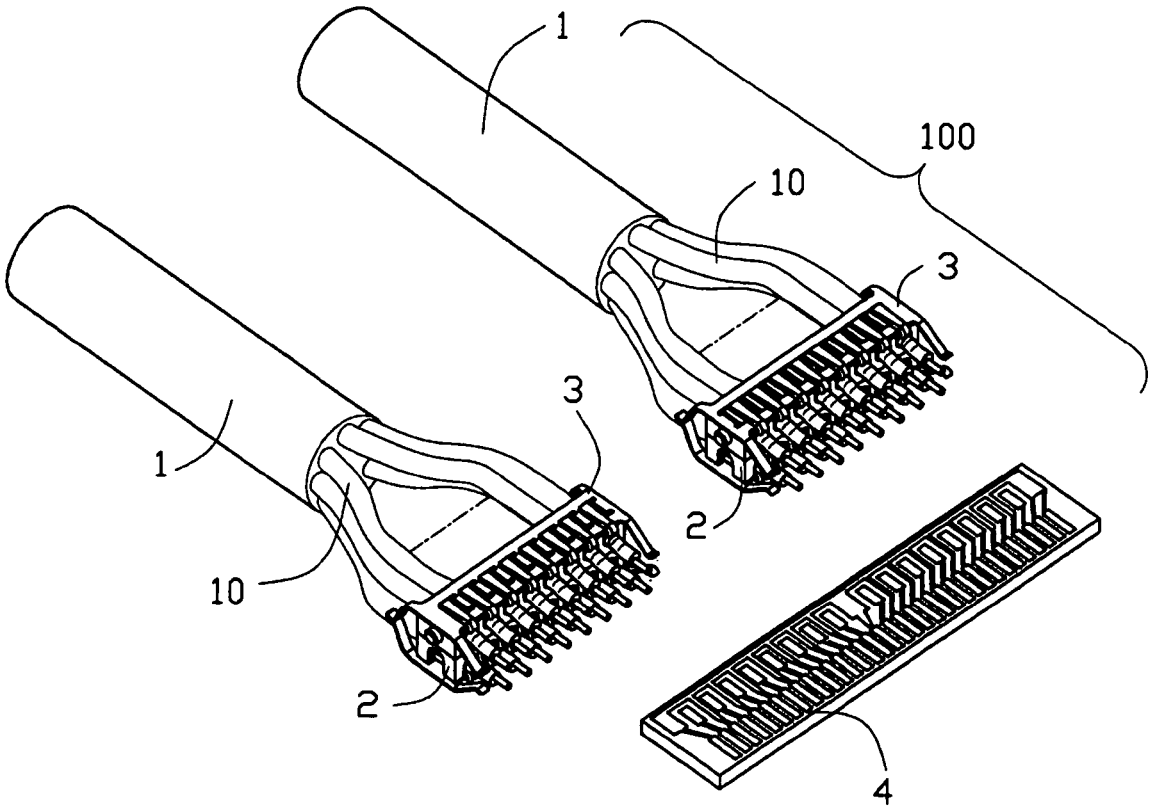
FIG. 2 is a partly exploded, perspective view of the connector assembly of FIG. 1.

With reference now to FIGS. 1–4, in assembling the connector assembly 100 in accordance with the present invention, the front ends of the wires 10 of the pair of multi-wire cables 1 are received in the passageways 202 of the halves 20 of corresponding organizers 2, respectively. Then, the presser-halves 30, 31 of the pair of pressers 3 attached to the organizer-halves 20, 21 of corresponding organizers 2 via cooperation between the slices 302, 312 of the pressers 3 and the slots 203 of the organizers 2. The presser-halves 30, 31 of the pressers 3 are so located that the signal conductor 101 of each wire 10 is located between two neighboring slices 302, 312 for effectively reducing cross talk, and the grounding conductor 103 of each wire 10 is beyond and overlaps the presser-halves 30, 31 for being soldered to the body 301, 311. Then, the organizer-halves 20, 21 form the organizer 2 via cooperation between the bulge portions 204 and corresponding recessed portions 205. The embodiment 206(216) located at lateral side of each organizer 2 press-fits into corresponding depression 207 (217) located at lateral side of the other organizer 2 to hold the pair of organizers 2 together. Finally, the grounding conductors 103 of the wires 10 of the multi-wire cables 1 are soldered to the bodies 301, 311 of the pressers 3. The signal conductors 101 of the wires 10 of the multi-wire cables 1 and the forwardly extending legs 304, 314 of the pressers 3 are soldered to corresponding signal circuit traces 41 and grounding circuit traces 40 covered on top and bottom surfaces of the rear end of the PCB 4, thereby the grounding conductors 103 of the wires 10 of the multi-wire cables 1 are electrically connected to the PCB 4 via the legs 304 of the pressers 3. The rearwardly extending legs 304 of the pressers 3 are soldered together to hold the organizers 2 tightly. The circuit traces of the front end of PCB 4 are to be electrically connected with the mating connector (not shown). Therefore, the connector assembly 100 of the connector assembly is completed as best shown in FIG. 1.

It is to be understood, however, that even though numerous, characteristics and advantages of the present invention have been set fourth in the foregoing description, together with details of the structure and function of the invention, the disclosed is illustrative only, and changes may be made in detail, especially in matters of shape, size, and arrangement of parts within the principles of the invention to the full extent indicated by the broad general meaning of the terms in which the appended claims are expressed.

What is claimed is:

1. A connector assembly comprising:

a cable having at least two pair of wires;

an organizer having a pair of organizer-halves stacked together and arranged in mirror-image, each organizer-half defining at least a pair of passageways receiving corresponding wires of the cable therein, thereby arranged the wires into an upper row and a lower row;

a presser having a pair of presser-halves attached to the organizer-halves of the organizer and pushing each of the wire into corresponding passageways; and a printed circuit board having at least a circuit trace on top and bottom surfaces thereof, each of the circuit traces electrically connected to corresponding wire of the cable;

wherein each of the organizer-halves has at least a bulge portion and a recessed portion, the bulge portion of one organizer-half press-fitting into the recessed portion in the other organizer-half to hold the organizer-halves together; wherein each organizer-half has a first wall and an opposite second wall, and wherein said bulge portion is formed on the first wall, and the second wall is slotted to form a plurality of partitions; wherein each of the presser-halves has a body and a plurality of slices generally extending vertically from the body, and wherein each organizer-half of the organizer defines a plurality of slots for receiving the slices; wherein each of the presser-halves further has at least a pair of legs extending outwardly from sides of the body, and wherein the legs are respectively connected with grounding traces of the printed circuit board; wherein; wherein the signal conductor of the wire is electrically connected to signed circuit traces of the printed circuit board, while the grounding conductor of the wire is electrically connected to the printed circuit board via the legs of the presser which is electrically connected to the grounding circuit traces of the printed board.

2. The connector assembly as claimed in claim 1, wherein each passageway of the organizer-half is defined between two neighboring partitions.

3. The connector assembly as claimed in claim 2, wherein the halves of the organizer are arranged in back-to-back relationship.

4. The connector assembly as claimed in claim 1, wherein the slots are respectively formed in corresponding partitions.

5. The connector assembly as claimed in claim 1, wherein the presser-halves are electrically connected together via the legs.

6. The connector assembly as claimed in claim 1, wherein the wire has a signal conductor and a grounding conductor which isolates from the signal conductor, and wherein the grounding conductor is connected with the presser-half.

7. A connector assembly comprises:

at least a pair of cables disposed side-by-side, each of the cables having a plurality of wires each comprising at least a signal conductor and a grounding conductor which isolates from the signal conductor;

an organizer defining at least a plurality of passageways for receiving the wires of the cables;

a presser attached to the organizer and pushing each of the wires in to corresponding passageways; and a printed circuit board secured to the cables and having a top and bottom surfaces covered with a plurality of circuit traces thereon for being terminated with corresponding signal conductors and grounding conductors of the wires of the cables;

wherein the organizer is formed of first and second organizer-halves mechanically connected with each other, and wherein the presser is formed of first and second presser-halves electrically connected with each other; wherein each presser-half has a body having a plurality of slices, and wherein each organizer-half defines a plurality of slots for receiving the slices; wherein the signal conductor of each wire of the cable is located between two neighboring slices of the presser, and the grounding conductor of each wire of the cable is electrically connected to the body of the presser; wherein the signal conductor of each wire of the cable is electrically connected to corresponding circuit traces of the printed circuit board, while the grounding conductor of each wire of the cable is electrically connected to the printed circuit board via the legs of the presser which is electrically connected to corresponding circuit traces of the printed circuit board.

8. The connector assembly as claimed in claim 7, wherein the first presser-half is attached to the first organizer-half, while the second presser-half is attached to the second organizer-half.

9. The connector assembly as claimed in claim 7, wherein each part of the presser further has at least a pair of legs extending outwardly from sides of the body, and wherein the legs electrically connect with the printed circuit board.

* * * * *